US007665299B2

(12) United States Patent
Schuh et al.

(10) Patent No.: US 7,665,299 B2
(45) Date of Patent: Feb. 23, 2010

(54) HYDRAULIC POWER MANAGEMENT SYSTEM

(75) Inventors: Scott N. Schuh, Fort Ransom, ND (US); Joseph A. St. Aubin, Wahpeton, ND (US)

(73) Assignee: Clark Equipment Company, West Fargo, ND (US)

( * ) Notice: Subject to any disclaimer, the term of this patent is extended or adjusted under 35 U.S.C. 154(b) by 290 days.

(21) Appl. No.: 11/684,966

(22) Filed: Mar. 12, 2007

(65) Prior Publication Data

US 2008/0223026 A1 Sep. 18, 2008

(51) Int. Cl.
*F16D 31/02* (2006.01)

(52) U.S. Cl. ..... 60/430; 60/429; 60/484; 60/486

(58) Field of Classification Search ..... 60/421, 60/429, 430, 468, 484, 486
See application file for complete search history.

(56) References Cited

U.S. PATENT DOCUMENTS

| | | | | |
|---|---|---|---|---|
| 3,439,768 | A | 4/1969 | Medley | |
| 4,164,119 | A | 8/1979 | Parquet | |
| 4,184,331 | A * | 1/1980 | Bentley | 60/430 |
| 4,449,365 | A | 5/1984 | Hancock | |
| 4,635,439 | A | 1/1987 | Wible | |
| 4,779,416 | A * | 10/1988 | Chatterjea et al. | 60/429 |
| 5,081,837 | A * | 1/1992 | Ueno | 60/430 |
| 5,615,553 | A | 4/1997 | Lourigan | |
| 5,617,724 | A | 4/1997 | Ko | |
| 5,768,973 | A | 6/1998 | Cochran | |
| 6,205,781 | B1 | 3/2001 | A'Hearn | |
| 6,293,099 | B1 | 9/2001 | Kamiya | |
| 6,293,765 | B1 | 9/2001 | Peterson | |
| 6,901,754 | B2 * | 6/2005 | Jervis | 60/430 |

FOREIGN PATENT DOCUMENTS

| | | |
|---|---|---|
| GB | 2 390 872 A | 1/2004 |
| JP | 2-213527 | 8/1990 |
| JP | 2-217528 | 8/1990 |
| JP | 2004150115 | 5/2004 |

OTHER PUBLICATIONS

Search Report and Written Opinion dated Jul. 10, 2008 for International application No. PCT/US2008/003161, filed Mar. 11, 2008.

* cited by examiner

*Primary Examiner*—Michael Leslie
(74) *Attorney, Agent, or Firm*—John D. Veldhuis-Kroeze; Westman, Champlin & Kelly, P.A.

(57) ABSTRACT

A machine having a hydraulic power management system. The machine includes an internal combustion engine driving first and second fixed displacement pumps to produce a combined flow of pressurized fluid. Main and auxiliary implements are operable in response to a flow of pressurized fluid, and a control valve selectively directs the combined flow to the main and auxiliary implements. A power management system is operable to stop the flow of pressurized fluid to the main implement from the second pump when the pressure of the combined flow exceeds a pressure indicative of the impending engine stall. A means for providing the combined flow to the auxiliary implement without regard to the pressure of the combined flow is also provided, and may take the form of a power management override or bypass mechanism.

17 Claims, 4 Drawing Sheets

HYDRAULIC POWER MANAGEMENT SYSTEM

BACKGROUND

The present invention relates to a hydraulic power management system that may be used, for example, in a compact construction vehicle such as a skid steer loader.

Skid steer loaders are typically equipped with a drive and steering system and a main implement, such as a lift arm with a bucket attachment. Hydraulic fluid is provided under pressure to the drive system and to the main implement by way of hydraulic pumps that are driven under the influence of an internal combustion engine.

In many skid steer loaders, the lift arm is raised and lowered under the influence of a lift cylinder, and the bucket is curled and dumped under the influence of a tilt cylinder. The bucket can be replaced or enhanced with various auxiliary implements, such as augers or jack hammers, which provide additional functionality to the skid steer loader. A main valve often controls the supply of hydraulic fluid to the lift cylinder, tilt cylinder, and auxiliary implement in response to actuation of a joystick or other control. In some skid steer loaders, hydraulic fluid from a first hydraulic pump is provided to the lift and tilt cylinders, while hydraulic fluid provided by a second hydraulic pump in addition to the first hydraulic pump is provided to the auxiliary device. In such systems, the pressure and flow of hydraulic fluid provided to the lift and tilt cylinders is often limited to avoid stalling the internal combustion engine. Such pressure and/or flow limitation may be achieved, for example, by using a variable displacement pump, a variable speed drive mechanism, a variable pressure relief valve, or a combination of such devices. However, such systems still may permit the pressure of fluid provided to the auxiliary device to reach levels that would stall the internal combustion engine, for instance, when the operator demands maximum work from the auxiliary implement.

SUMMARY

The invention provides a machine comprising an internal combustion engine having an output threshold below which the internal combustion engine operates and at which the internal combustion engine stalls. First and second fixed displacement pumps are driven by operation of the internal combustion engine to produce a combined flow of pressurized fluid. Main and auxiliary implements are operable in response to a flow of pressurized fluid, and a control valve selectively directs the combined flow to the main and auxiliary implements. A power management system is operable to stop the flow of pressurized fluid to the main implement from the second pump when the pressure of the combined flow exceeds a pressure indicative of the engine reaching the output threshold. The invention also provides a means for providing the combined flow to the auxiliary implement without regard to the pressure of the combined flow.

In some embodiments, the means for providing the combined flow may include an override mechanism that disables operation of the power management system in response to the control valve directing the combined flow to the auxiliary implement. In other embodiments, the means for providing the combined flow may include a bypass valve for providing the flow of pressurized fluid from the second pump to the auxiliary implement without flowing through the control valve. The invention may be embodied in a compact construction vehicle, such as a skid steer loader. In such embodiments, the main implement may include a lift arm and a bucket, for example.

The invention also provides a method for operating a machine that includes an internal combustion engine, first and second fixed displacement pumps, a main implement, and an auxiliary implement. The method comprises (a) driving operation of the first and second fixed displacement pumps with the internal combustion engine; (b) producing a combined flow of pressurized fluid with the first and second pumps; (c) selectively operating the main and auxiliary implements with the combined flow of pressurized fluid; (d) sensing the pressure of the combined flow; (e) preventing the flow of pressurized fluid to the main implement from the second pump when the pressure of the combined flow exceeds a pressure indicative of potential engine stall; and (f) permitting the combined flow of pressurized fluid to the auxiliary implements without regard to the pressure of the combined flow.

The invention therefore permits a main implement (e.g., the lift and tilt functions of a skid steer loader), in addition to an auxiliary implement, to utilize the combined flow from two fixed displacement pumps.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
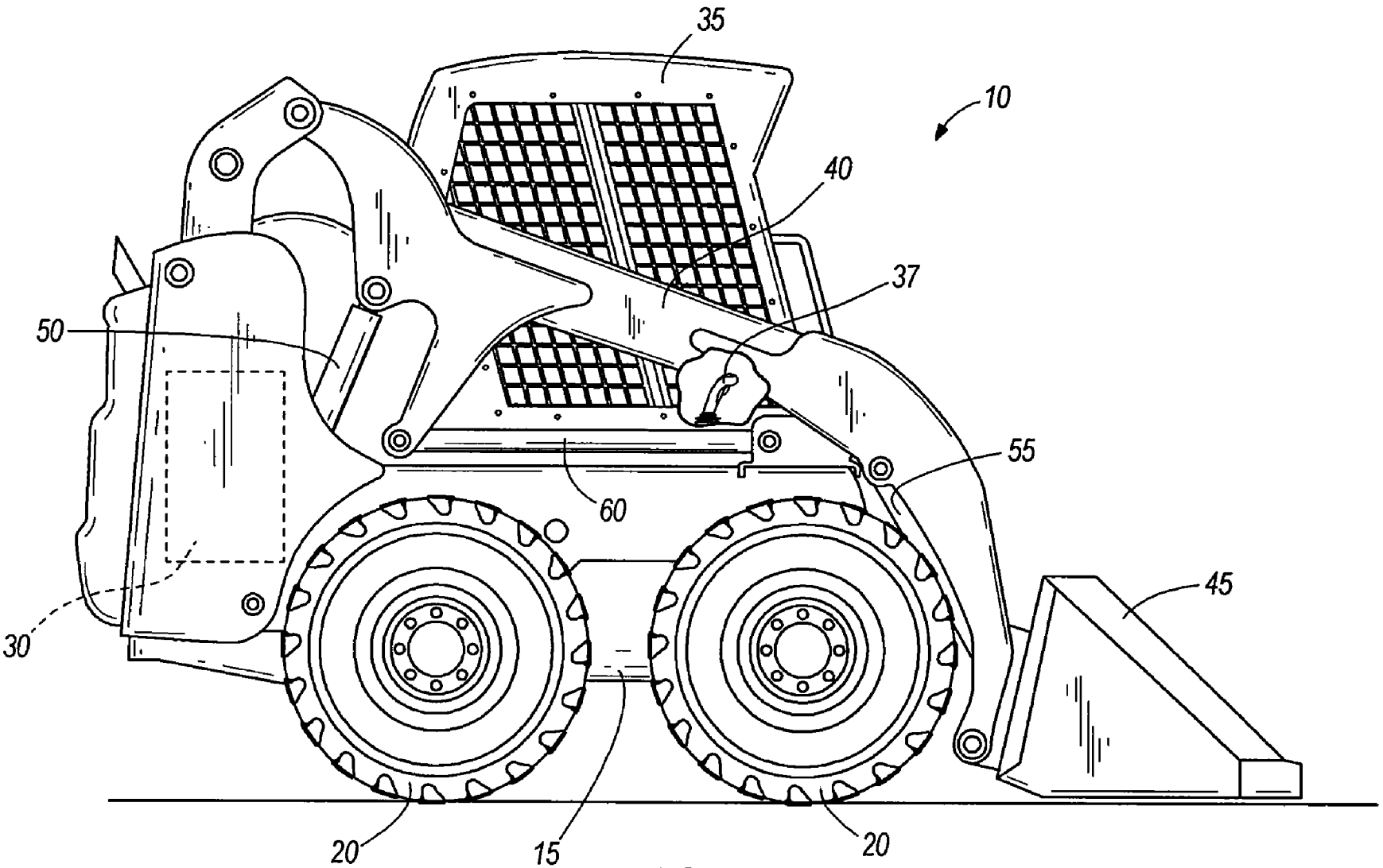
FIG. 1 is a side view of a vehicle including a hydraulic management circuit embodying the present invention.
Figure 2:
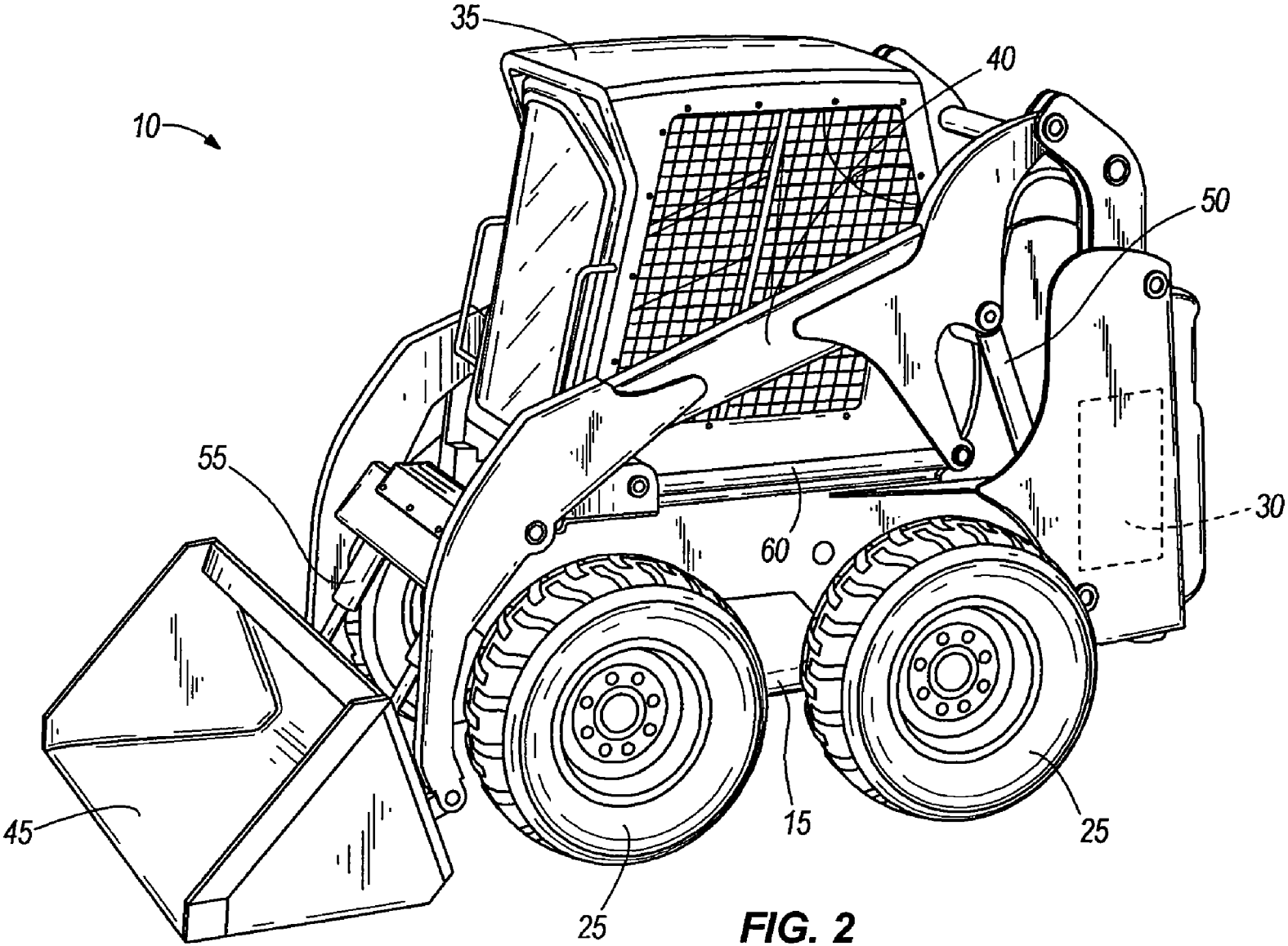
FIG. 2 is a perspective view of the vehicle

FIGS. 1 and 2 depict a skid steer loader 10 having a frame 15 supported by two right side wheels 20 and two left side wheels 25, an internal combustion engine 30, an operator compartment 35 that contains an operator control 37, right and left lift arms 40, and a bucket 45 mounted for tilting between the distal ends of the lift arms 40. Although the invention is illustrated embodied in a skid steer loader 10, the invention may be embodied in other vehicles and machines. Although the illustrated operator control 37 takes the form of a joystick, in other embodiments, the control may include multiple joysticks and/or foot pedals.

The right side wheels 20 are driven independently of the left side wheels 25. When all four wheels 20, 25 turn at the same speed, the loader 10 moves forward and backward, depending on the direction of rotation of the wheels 20, 25. The loader 10 turns by rotating the right and left side wheels 20, 25 in the same direction but at different rates, and rotates about a substantially zero turn radius by rotating the right and left side wheels 20, 25 in opposite directions.

The lift arms 40 raise (i.e., rotate counterclockwise in FIG. 1) and lower (i.e., rotate clockwise in FIG. 1) with respect to the frame 15 under the influence of lift cylinders 50 mounted between the frame 15 and the lift arms 40. The bucket 45 tilts with respect to the arms 40 to curl (i.e., rotate counterclockwise in FIG. 1) and dump (i.e., rotate clockwise in FIG. 1) under the influence of tilt cylinders 55 mounted between the lift arms 40 and the bucket 45. Various auxiliary implements or devices may be substituted for or used in conjunction with the bucket 45. An example, but by no means exhaustive, list of auxiliary implements includes augers, jack hammers, trenchers, grapples, rotary sweepers, stump grinders, saws, concrete mixers, pumps, chippers, snow throwers, rotary cutters, and backhoes.

Figure 3:
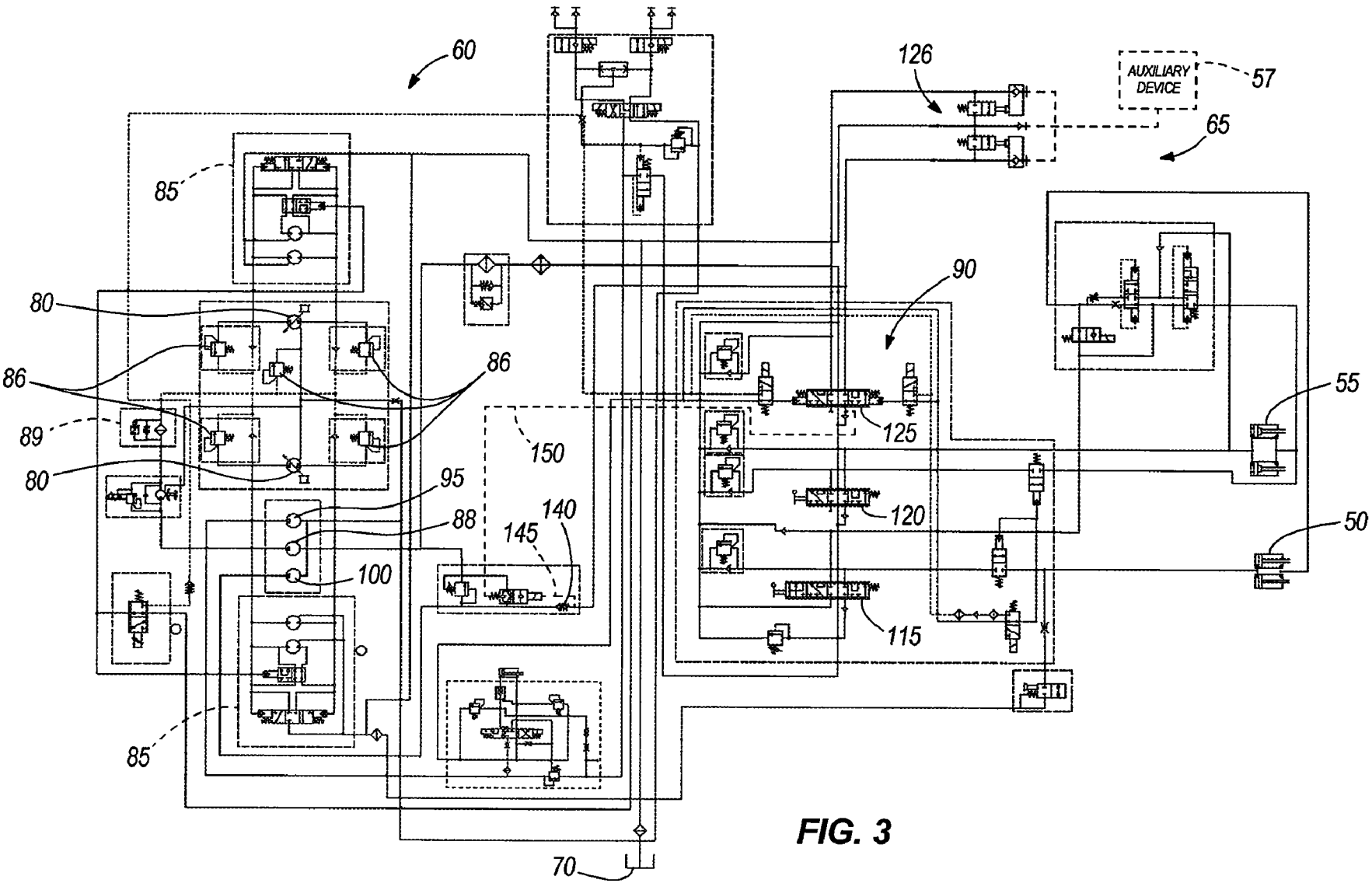
FIG. 3 is an overall hydraulic circuit schematic for the vehicle.

Turning now to FIG. 3, the overall hydraulic circuit of the skid steer loader 10 includes a drive portion 60 and an implement portion 65, both of which communicate with an oil reservoir 70, and both of which are controlled by the operator control 37. The drive portion 60 of the circuit controls the rate and direction of rotation of the wheels 20, 25 to control forward and reverse movement, steering, and rotating of the skid steer loader 10. The drive portion 60 includes bidirectional variable displacement hydrostatic pumps 80 and right and left side drive motors 85 to control the wheels 20, 25. The drive portion 60 also includes relief valves 86, a fixed displacement charge pump 88, and a hydraulic charge filter 89 that work together to operate the drive portion 60 of the circuit.

Figure 4:
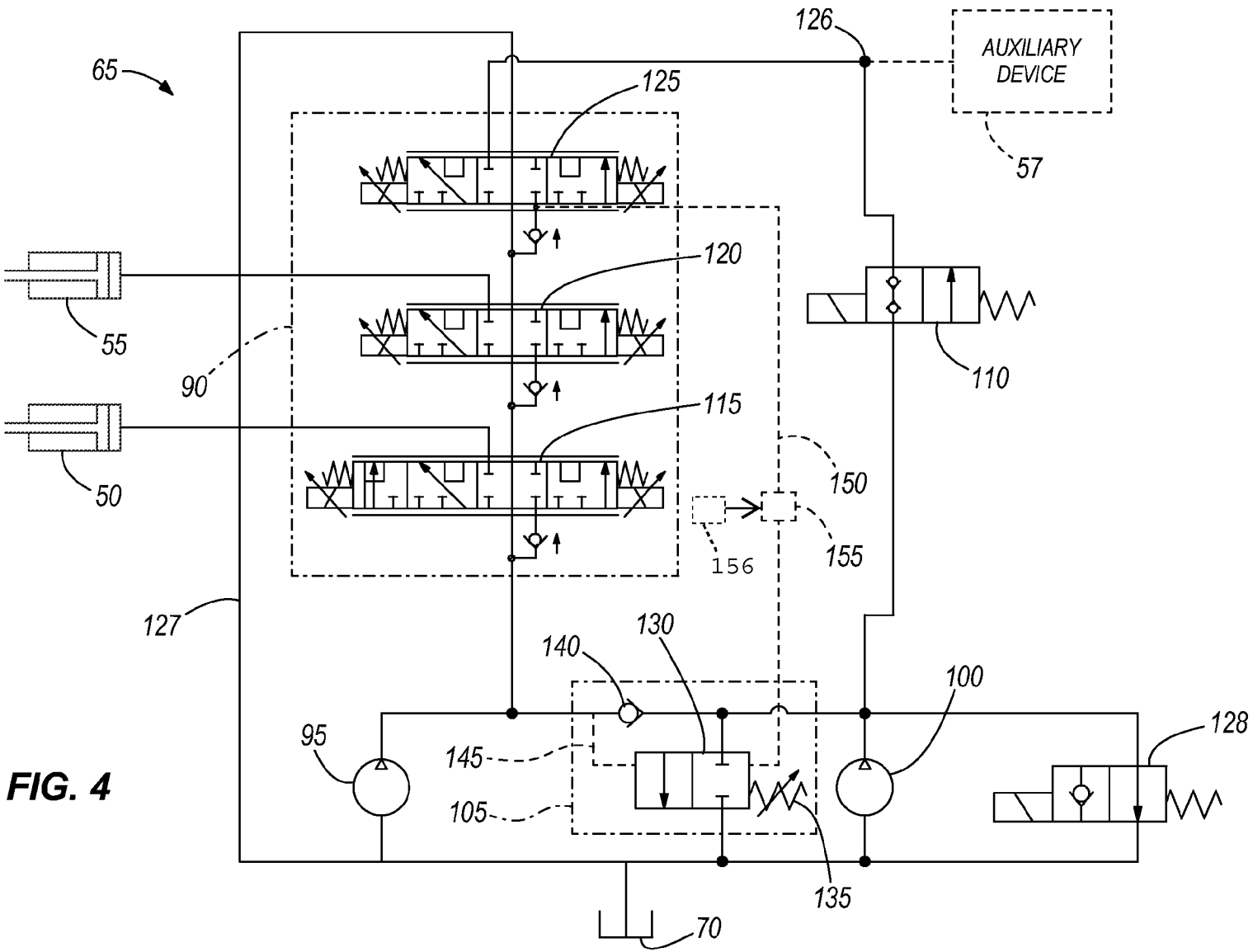
FIG. 4 is an enlarged, detailed schematic of the implement portion of the overall schematic.

With reference to FIG. 4, the implement portion 65 of the circuit includes a main control valve ("MCV") 90, a first pump 95, a second pump 100, a power management system 105, and an optional bypass valve 110. The MCV 90 includes a lift spool 115, a tilt spool 120, and an auxiliary spool 125, all of which are illustrated in neutral or center positions in which no hydraulic fluid flows past the spools 115, 120, 125. The lift, tilt, and auxiliary spools 115, 120, 125 may be shifted with the controls 37 from their neutral positions to permit hydraulic fluid to flow to the lift cylinders 50, tilt cylinders 55, and auxiliary devices or implements 57, respectively. Auxiliary implements 57 are plugged into the implement portion 65 of the hydraulic circuit at a coupler 126, which may be of substantially any type and be male or female. The implement portion 65 of the hydraulic circuit therefore provides hydraulic fluid to a main implement (e.g., the lift and tilt cylinders 50, 55 for the lift arms 40 and bucket 45) and an auxiliary implement (e.g., whatever auxiliary implement 57 is attached at the coupler 126).

In the illustrated embodiment, the first and second pumps 95, 100 are fixed displacement pumps, and are driven at constant speed under the influence of the internal combustion engine 30. In the illustrated embodiment, the first and second pumps 95, 100 provide hydraulic fluid at rates of sixteen and ten gallons per minute, respectively. In other embodiments, the first and second pumps 95, 100 may provide hydraulic fluid at other rates that are most suitable for the vehicle or machine in which they are incorporated. The first and second pumps 95, 100 are both in fluid communication with the MCV 90, and therefore both supply pressurized hydraulic fluid to the lift, tilt, and auxiliary spools 115, 120, 125. A return line 127 returns hydraulic fluid to the reservoir 70 after it passes through the MCV 90.

Should an operator wish to disable the second pump 100 (i.e., provide no hydraulic fluid from the second pump 100 to the MCV 90), an on/off valve 128 may be moved into the illustrated open position to place the second pump 100 in communication with the reservoir 70. Otherwise, when the operator wishes to use pressurized hydraulic fluid from both pumps 95, 100, the on/off valve 128 is shifted into a closed condition.

The first pump 95 is in direct communication with the MCV 90 while the second pump 100 communicates with the MCV 90 through the power management system 105. The illustrated power management system 105 includes a power management loop valve 130 that is biased into the illustrated closed position by a valve spring 135. The power management system 105 also includes a check valve 140 that permits one-way flow of hydraulic fluid out of the power management system 105 and into the MCV 90.

The power management system 105 further includes first and second pilot or reference signal lines 145, 150 acting on (i.e., providing a pilot or reference signal to) opposite ends of the valve 130. The first pilot signal line 145 taps into the hydraulic circuit on the MCV side of the check valve 140 to provide a force against the bias of the spring 135 in proportion to the hydraulic pressure being provided to the MCV 90 (i.e., the combined hydraulic pressure from the first and second pumps 95, 100). The spring 135 is calibrated to deflect when the hydraulic pressure approaches or reaches a level at which the engine 30 may stall, such hydraulic pressure level referred to herein as "stall pressure." The engine 30 reaches its output threshold when the stall pressure is attained, and the engine stalls.

When the pressure of hydraulic fluid being provided to the MCV 90 reaches the stall pressure, the spring 135 deflects and the valve 130 opens. When the valve 130 is open, hydraulic fluid from the second pump 100 follows the path of least resistance to the reservoir 70 and the check valve 140 closes. In this regard, the valve 130 may be called a redirecting mechanism. When the hydraulic pressure to the MCV 90 again drops below the stall pressure, the spring 135 shifts the valve 130 to the closed position and the check valve 140 opens so that hydraulic fluid from both pumps 95, 100 is again provided to the MCV 90.

The second pilot line 150 taps into the hydraulic circuit at the auxiliary spool 125, and acts in the same direction as the spring 135 bias. The second pilot line 150 provides this signal to the valve 130 only when the auxiliary spool 125 is opened. Because of hydraulic pressure drop through the MCV 90, the pressure in the second pilot line 150 is slightly lower than the pressure in the first pilot line 145. The bias of the spring 135 more than compensates for the pressure difference in the first and second pilot lines 145, 150 such that the combined forces of the spring 135 and second pilot line 150 are equal to or greater than the force of the first pilot line 145. Consequently, the spring 135 will not deflect when the auxiliary spool 125 is out of its neutral or center position, and the operator of the skid steer loader 10 may provide maximum power to the auxiliary implement 57, even up to the stall pressure. The operator may also provide maximum power to the lift and tilt cylinders 50, 55 when the auxiliary spool 125 is off center, since the valve 130 is locked closed.

To further maximize power to the auxiliary implement 57, the optional bypass valve 110 may be used. The optional bypass valve 110 is opened by the operator when the auxiliary implement 57 is activated (i.e., upon shifting the auxiliary spool 125 off center). When open, the bypass valve 110 provides a direct line from the second pump 100 to the auxiliary implement 57, which avoids the pressure drop that arises when all hydraulic fluid flows through the MCV 90. Hydraulic fluid will follow the path of least resistance from the second pump 100 to the auxiliary implement 57 through the open bypass valve 110, and not go through the power management system 105 and MCV 90. As a result, the check valve 140 closes and hydraulic fluid pressurized only by the first pump 95 flows to the auxiliary implement 57 through the MCV 90. The first and second pilot lines 145, 150 keep the valve 130 closed under such circumstances.

The second pilot line 150 and the optional bypass valve 110 may be considered part of an auxiliary high flow mechanism that permits the auxiliary implement 57 to receive the combined flow of hydraulic fluid from the pumps 95, 100 without regard to the pressure of hydraulic fluid flowing into the MCV 90.

The second pilot line 150 enables the combined flow to enter the MCV 90 (i.e., to each of the lift, tilt, and auxiliary spools 115, 120, 125) and disables the relief valve 130 as long as the auxiliary spool 125 is shifted from its center position, and therefore acts as a power management system override mechanism. In other embodiments, the power management system override mechanism may include sensors and electric or electromechanical actuators to lock the valve 130 closed, instead of using pressure in the pilot or reference lines 145, 150.

The optional bypass valve 110 permits the combined flow to be provided to the auxiliary implement 57 with only the hydraulic fluid from the first pump 95 having passed through the MCV 90, and therefore acts as a power management system bypass mechanism.

An optional feature to further maximize or control auxiliary device operation is a solenoid or other suitable override disabling valve 155 in the second pilot line 150. The disabling valve 155 is operable to close off communication between the auxiliary spool 125 and the valve 130, thereby effectively disabling the functionality of the second pilot line 150 (i.e., disabling the power management override) to permit operation of the power management system 105 during operation of auxiliary devices 57. One example of a situation in which it may be desirable to enable the power management system 105 during auxiliary device operation is when the auxiliary device 57 is intended to operate in a high-torque mode rather than a high-speed mode. With the power management system 105 enabled, only hydraulic fluid from the first pump 95 is provided to the auxiliary device 57 once the valve 130 is opened. This results in the provision of hydraulic fluid to the auxiliary device 57 at a higher pressure, albeit at a lower flow rate, which is conducive to a higher torque mode of operation for the auxiliary device 57.

Another example of a situation in which it may be desirable to enable the power management system 105 during auxiliary device operation is when the auxiliary device 57 is intended to operate in a high-speed mode of operation, but the internal combustion engine 30 is approaching stall. Assuming that the stall pressure has been achieved in this situation, enabling the power management system 105 will take the second pump 100 off line. This would result in the provision of hydraulic fluid to the auxiliary device 57 only from the first pump 95, but also permits the engine 30 to recover from stalling. As the engine speed increases under the reduced load, it is able to drive the first pump 95 faster and provide a higher flow rate to the auxiliary device than would be possible with the first and second pumps 95, 100 when the engine was approaching stall. To enable the power management system 105 under such circumstances, the override disabling valve 155 may operate in response to engine speed, with a control system 156 enabling the power management system 105 through the disabling valve 155 when engine speed (e.g., as measured in revolutions per minute or "rpm") drops below a threshold speed at which it is assumed that a higher flow rate would be achieved by the first pump 95 alone.

The disabling valve 155 operates in both examples above as a means for selectively disabling the second pilot line 150 to permit the power management system 105 to operate under circumstances in which operation of the auxiliary device 57 is optimized (whether in high-torque or high-speed mode) by the supply of hydraulic fluid from only one of the first and second pumps 95, 100.

Various features and advantages of the invention are set forth in the following claims.

What is claimed is:

1. A compact construction vehicle comprising:

a frame;

a lift arm supported by and pivotable with respect to the frame;

a bucket supported by and pivotable with respect to the lift arm;

an internal combustion engine on the frame, the engine having an output threshold below which the internal combustion engine operates and at which the internal combustion engine stalls;

first and second fixed displacement pumps driven by the internal combustion engine to create a combined flow of pressurized fluid;

a lift cylinder adapted to pivot the lift arm in raising and lowering directions in response to receiving pressurized fluid;

a tilt cylinder adapted to pivot the bucket in curling and dumping directions in response to receiving pressurized fluid;

an auxiliary implement adapted to perform work in response to receiving pressurized fluid;

a main control valve receiving the combined flow of pressurized fluid, the main control valve including lift, tilt, and auxiliary spools, each spool having a center position, and each movable from the center position to direct the combined flow of pressurized fluid to the respective lift cylinder, tilt cylinder, and auxiliary implement;

a power management system for preventing pressurized fluid from the second pump to flow to the main control valve when the pressure of pressurized fluid flowing to the main control valve exceeds a stall pressure indicative of the engine reaching the output threshold; and an auxiliary high flow mechanism for permitting the combined flow of pressurized fluid to flow to the auxiliary implement when the auxiliary spool is moved from its center position, without regard to whether the pressure of pressurized fluid flowing into the main control valve exceeds the stall pressure, wherein the auxiliary high flow mechanism includes a reference signal line providing a reference signal indicative of the auxiliary spool shifting off its center position the reference signal disabling the power management system from preventing pressurized fluid from the second pump to flow to the main control valve and to the lift, tilt, and auxiliary spools.

2. The vehicle of claim 1, wherein the auxiliary high flow mechanism includes a bypass valve routing pressurized fluid from the second pump to the auxiliary implement without flowing through the main control valve.

3. The vehicle of claim 1, wherein the power management system includes a power management valve shiftable between a first position in which the second pump provides pressurized fluid to the main control valve, and a second position in which the second pump is prevented from providing pressurized fluid to the main control valve.

4. The vehicle of claim 3, wherein the power management system includes a reference signal indicative of the pressure of pressurized fluid flowing into the main control valve, wherein the power management valve is shifted to the second position in response to the reference signal indicating the pressure exceeding the stall pressure.

5. The vehicle of claim 1, wherein the first and second fixed displacement pumps are driven at constant speed under the influence of the engine.

6. A method for operating a machine that includes an internal combustion engine, first and second fixed displacement pumps, a main implement, and an auxiliary implement, the method comprising:

(a) driving operation of the first and second fixed displacement pumps with the internal combustion engine;

(b) producing a combined flow of pressurized fluid with the first and second pumps;

(c) selectively operating the main and auxiliary implements with the combined flow of pressurized fluid;

(d) sensing the pressure of the combined flow;

(e) preventing the flow of pressurized fluid to the main implement from the second pump when the pressure of the combined flow exceeds a pressure indicative of potential engine stall; and (f) permitting the combined flow of pressurized fluid to the auxiliary implements without regard to the pressure of the combined flow, further comprising sensing whether pressurized fluid is being provided to the auxiliary implement and permitting flow of pressurized fluid to the auxiliary implement and main implement without regard to the pressure of the combined flow while pressurized fluid is being provided to the auxiliary implement.

7. The method of claim 6, wherein step (e) includes using a redirecting mechanism to route pressurized fluid from the second pump into a reservoir; and wherein step (f) includes disabling the redirecting mechanism.

8. The method of claim 6, wherein step (c) includes using a control valve to direct the combined flow to the main and auxiliary implements, and wherein step (f) includes routing the flow of pressurized fluid from the second pump to the auxiliary implement without flowing through the control valve.

9. The method of claim 6, wherein step (a) includes driving the first and second fixed displacement pumps at constant speed under the influence of the engine.

10. A compact construction vehicle comprising:

a frame;

a lift arm supported by and pivotable with respect to the frame;

a bucket supported by and pivotable with respect to the lift arm;

an internal combustion engine on the frame, the engine having an output threshold below which the internal combustion engine operates and at which the internal combustion engine stalls;

first and second fixed displacement pumps driven by the internal combustion engine to create a combined flow of pressurized fluid;

a lift cylinder adapted to pivot the lift arm in raising and lowering directions in response to receiving pressurized fluid;

a tilt cylinder adapted to pivot the bucket in curling and dumping directions in response to receiving pressurized fluid;

an auxiliary implement adapted to perform work in response to receiving pressurized fluid;

a main control valve receiving the combined flow of pressurized fluid, the main control valve including lift, tilt, and auxiliary spools, each spool having a center position, and each movable from the center position to direct the combined flow of pressurized fluid to the respective lift cylinder, tilt cylinder, and auxiliary implement;

a power management system for preventing pressurized fluid from the second pump to flow to the main control valve when the pressure of pressurized fluid flowing to the main control valve exceeds a stall pressure indicative of the engine reaching the output threshold; and an auxiliary high flow mechanism for permitting the combined flow of pressurized fluid to flow to the auxiliary implement when the auxiliary spool is moved from its center position, without regard to whether the pressure of pressurized fluid flowing into the main control valve exceeds the stall pressure, wherein the auxiliary high flow mechanism disables the power management system; and a disabling mechanism which selectively disables the auxiliary high flow mechanism to permit the power management system to operate under circumstances in which operation of the auxiliary device is optimized by the supply of fluid from only the first pump.

11. The vehicle of claim 10, further comprising a control system configured to control the disabling mechanism in response to engine speed dropping below a speed threshold at which the combined flow rate provided by the first and second pumps is lower than a flow rate that would be provided by only the first pump with the engine operating at a speed higher than the speed threshold.

12. The vehicle of claim 11, wherein the control system enables the power management system through the disabling mechanism when the engine speed drops below the threshold speed.

13. The vehicle of claim 10, wherein the auxiliary high flow mechanism includes a reference signal indicative of the auxiliary spool shifting off its center position, the reference signal disabling the power management system from preventing pressurized fluid from the second pump to flow to the main control valve.

14. The vehicle of claim 10, wherein the auxiliary high flow mechanism includes a bypass valve routing pressurized fluid from the second pump to the auxiliary implement without flowing through the main control valve.

15. The vehicle of claim 10, wherein the power management system includes a power management valve shiftable between a first position in which the second pump provides pressurized fluid to the main control valve, and a second position in which the second pump is prevented from providing pressurized fluid to the main control valve.

16. The vehicle of claim 15, wherein the power management system includes a reference signal indicative of the pressure of pressurized fluid flowing into the main control valve, wherein the power management valve is shifted to the second position in response to the reference signal indicating the pressure exceeding the stall pressure.

17. The vehicle of claim 10, wherein the first and second fixed displacement pumps are driven at constant speed under the influence of the engine.

* * * * *

UNITED STATES PATENT AND TRADEMARK OFFICE

CERTIFICATE OF CORRECTION

PATENT NO. : 7,665,299 B2
APPLICATION NO. : 11/684966
DATED : February 23, 2010
INVENTOR(S) : Schuh et al.

It is certified that error appears in the above-identified patent and that said Letters Patent is hereby corrected as shown below:

Column 6,

Line 56, delete "position" and insert --position,--.

Signed and Sealed this

Eighth Day of June, 2010

David J. Kappos

David J. Kappos
*Director of the United States Patent and Trademark Office*